US005507472A

United States Patent [19]

Bitsch et al.

[11] Patent Number: 5,507,472

[45] Date of Patent: Apr. 16, 1996

[54] HOIST WITH A LIFTING DEVICE

[75] Inventors: Harald Bitsch, Witten; Heinz Hasselmann, Hagen; Johannes Kluge; Wolfgang Krebs, both of Wetter; Uwe Lichtenvort, Essen; Anton Münzebrock, Dortmund; Günter Somborn, Hagen, all of Germany

[73] Assignee: Mannesmann Aktiengesellschaft, Dusseldorf, Germany

[21] Appl. No.: 116,447

[22] Filed: Sep. 3, 1993

[30] Foreign Application Priority Data

Sep. 3, 1992 [DE] Germany ..... 42 29 674.9

[51] Int. Cl.[6] ..... B66D 1/00

[52] U.S. Cl. ..... 254/264

[58] Field of Search ..... 254/360, 361, 254/362, 270, 372, 264; 200/522, 61.85, 298

[56] References Cited

U.S. PATENT DOCUMENTS

| | | | |
|---|---|---|---|
| 3,086,090 | 4/1963 | Carroll | 200/298 |
| 3,858,845 | 1/1975 | Grote et al. | 254/266 |
| 3,931,486 | 1/1976 | Raetz | 200/522 |
| 4,026,526 | 5/1977 | Messerschmidt et al. | 254/264 |
| 4,849,587 | 7/1989 | Bacon | 200/298 |

FOREIGN PATENT DOCUMENTS

| | | | |
|---|---|---|---|
| 2227364 | 7/1990 | United Kingdom | 200/298 |

*Primary Examiner*—Katherine Matecki
*Attorney, Agent, or Firm*—Cohen, Pontani, Lieberman, Pavane

[57] ABSTRACT

A hoist, including: load suspension device, a lifting means for raising and lowering the load suspension device; a traction mechanism connecting the suspension device with the lifting device; and a control device for the lifting device and the load suspension device. The control device is connected with the load suspension device and including a housing, a handle for manipulating the load suspension means, switching members arranged in the housing which are actuable for controlling the lifting device, and switching rockers arranged in the housing so as to be able to actuate the switching members. The switching rockers are each inclined toward the handle and are swivable around and connected to one end of a rocker shaft extending horizontally when the control device is considered as vertically suspended from the traction mechanism. The switching members are located so as to be reachable by a thumb of an operator's hand grasping the handle, while the handle is curved so that an imaginary line continuing from an outer surface of the handle intersects each of the switching rockers near supporting surfaces of the switching rockers. The supporting surface of each of the switching rockers includes a central region located opposite the rocker shaft so as to receive the operator's thumb in a neutral position and two edge regions that adjoin a top and a bottom of the central region at an angle in a direction tranverse to the rocker shafts so as to receive the operator's thumb in a switching position.

15 Claims, 4 Drawing Sheets

Fig.4
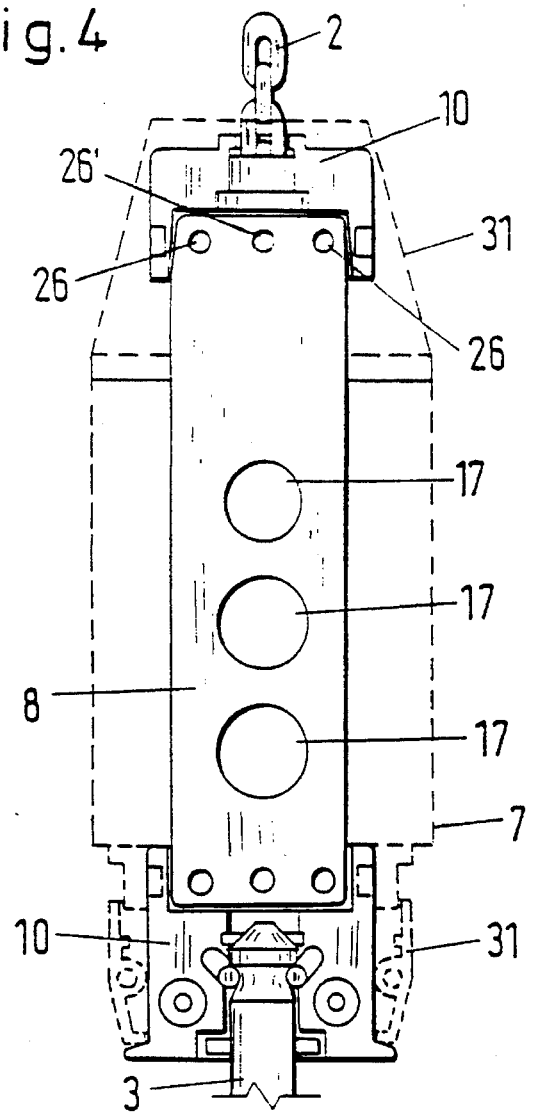
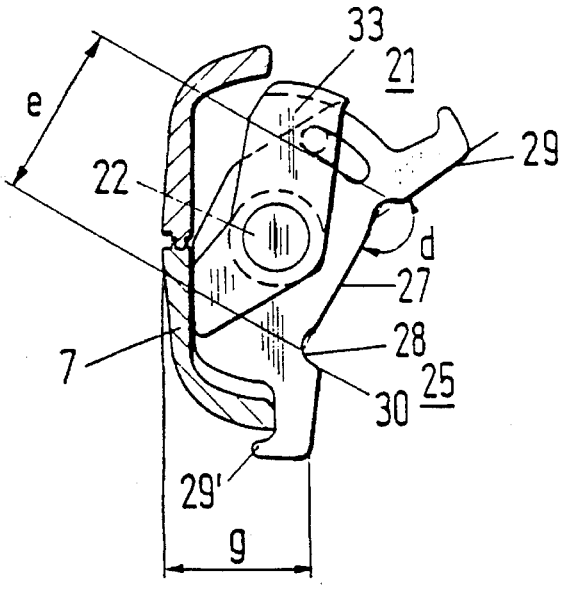
Fig.5

HOIST WITH A LIFTING DEVICE

BACKGROUND OF THE INVENTION

1. Field of the Invention

The invention is directed to a hoist with a lifting device, by means of which a load suspension device connected with the lifting device via a traction mechanism can be raised and lowered.

2. Description of the Prior Art

Such a hoist with a lifting device is known from DE 25 13 031 C2. The lifting device is connected with a traction mechanism which can be wound up and wound off by the lifting device, a control device being arranged at the free end of the traction mechanism. A load suspension device is fastened to the control device. Moreover, the control device has a housing to which is fastened a straight, horizontally arranged gripping piece for manipulating the load suspended from the load suspension device. Actuating means for switching members for controlling the lifting device are constructed as switching rockers and are arranged at both sides of the housing in the region of the ends of the gripping piece. A person grasping the handle can reach the switching rockers with his thumb without having to release the handle. Also, the switching rockers are swivelable around horizontally arranged rocker shafts as well as transversely to the gripping surface. The rocker shafts are in turn connected with a switching shaft of the switching member via bevel gear segments. Moreover, the switching rocker is arranged vertically in the neutral position and its actuating surface for the thumb of the operator is inclined slightly toward the handle. The longitudinal dimension of the handle is arranged approximately at fight angles to the rocker shafts.

This construction of the housing, which is characterized by the linear gripping piece and the rocker shafts arranged at fight angles to the latter with associated switching rockers, has shown itself to be disadvantageous with respect to ergonomics. Moreover, actuation of the switching members requires great switching forces due to the design and arrangement of the switching rocker.

SUMMARY OF THE INVENTION

Accordingly, it is an object of the present invention to provide a hoist with a lifting device and a control device acting on the load suspension device which ensures a user-friendly and accordingly safe handling of the control device, particularly in extreme positions of the control device.

Pursuant to this object, and others which will become apparent hereafter, one aspect of the present invention resides in a hoist of the generic type having a lifting device and a control device arranged at a load suspension device, in which the control device has a handle that is curved so that an imaginary line continuing from the outside of the handle intersects rocker switches in the region of their supporting surfaces. The supporting surface of the rocker switch has a central region for receiving an actuating thumb of an operator in a neutral position, and two edge regions which adjoin the central region at the top and bottom at an angle transverse to the rocker shaft of the switch.

As a result of the handle being curved so that an imaginary line continuing from the outside of the handle intersects the supporting surface for the actuating thumb at the pressing member, which is constructed in particular as a switching rocker, the hoist according to the invention has advantages that include that the supporting surface at the pressing member and the outside of the handle enclose an obtuse angle relative to one another so that the actuating thumb does not become tired and an ergonomically beneficial attitude of the actuating thumb is achieved while the operator simultaneously grasps the handle with his other fingers. Also, greater freedom of movement is given to the ball of the hand in that the outside of the handle is shifted back as seen in the direction of the switching rockers proceeding from the center of the handle. This facilitates the actuation of the switching rockers. Moreover, the curved construction of the handle allows the thumb to move in the direction of the switching rocker even while gripping the handle. The entire surface of the operator's hand also contacts the curved outside of the handle and promotes a non-fatiguing operation of the control device. The switching rocker is constructed as a two-armed lever with edge regions serving as an actuating surface. The selected distance between the edge regions and the rocker shaft is large so that the thumb transmits the switching forces to the rocker shaft via a long effective lever arm. This minimizes the switching forces and accordingly reduces fatigue when actuating.

Furthermore, the construction of the supporting surface at the switching rocker has proven advantageous in that the operator can clearly sense the position of his thumb on the switching rocker without glancing at the switching rocker as a result of the distinct division of the supporting surface into a central region for the thumb in the neutral position and two edge regions adjoining the central region at the top and bottom at an angle thereto for actuating the switching rocker. The arrangement of the rocker shafts for the switching rockers at an angle of 70° to 85°, particularly 83°, relative to the lever shaft for actuating the switching members has proven particularly advantageous, since the supporting surfaces for the actuating thumb accordingly lie within the lateral boundary defined by the contour of the housing. This prevents injury to the thumb, particularly due to pinching, when manipulating the control device for approaching a planar object from the side. A minimizing of switching force is achieved by means of designing the switching members as push snap-switches in combination with the two-armed lever arranged on the lever shaft and with the toothed wheel segments for transmitting the rotational movement of the rocker shaft to the lever shaft. Additionally, since the edge region of the switching rocker, which also has a projection in the direction of the housing, is constructed so as to project over the contour of the housing, the switching rocker can also be actuated in the direction of the projection proceeding from the housing in extreme positions of the control device.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

FIG. 4 shows a front view of a connecting element with connection pieces for a traction mechanism and a load suspension device; and FIG. 5 shows a switching rocker according to section line II—II in FIG. 3.

DETAILED DESCRIPTION OF THE PREFERRED EMBODIMENTS

Figure 1:
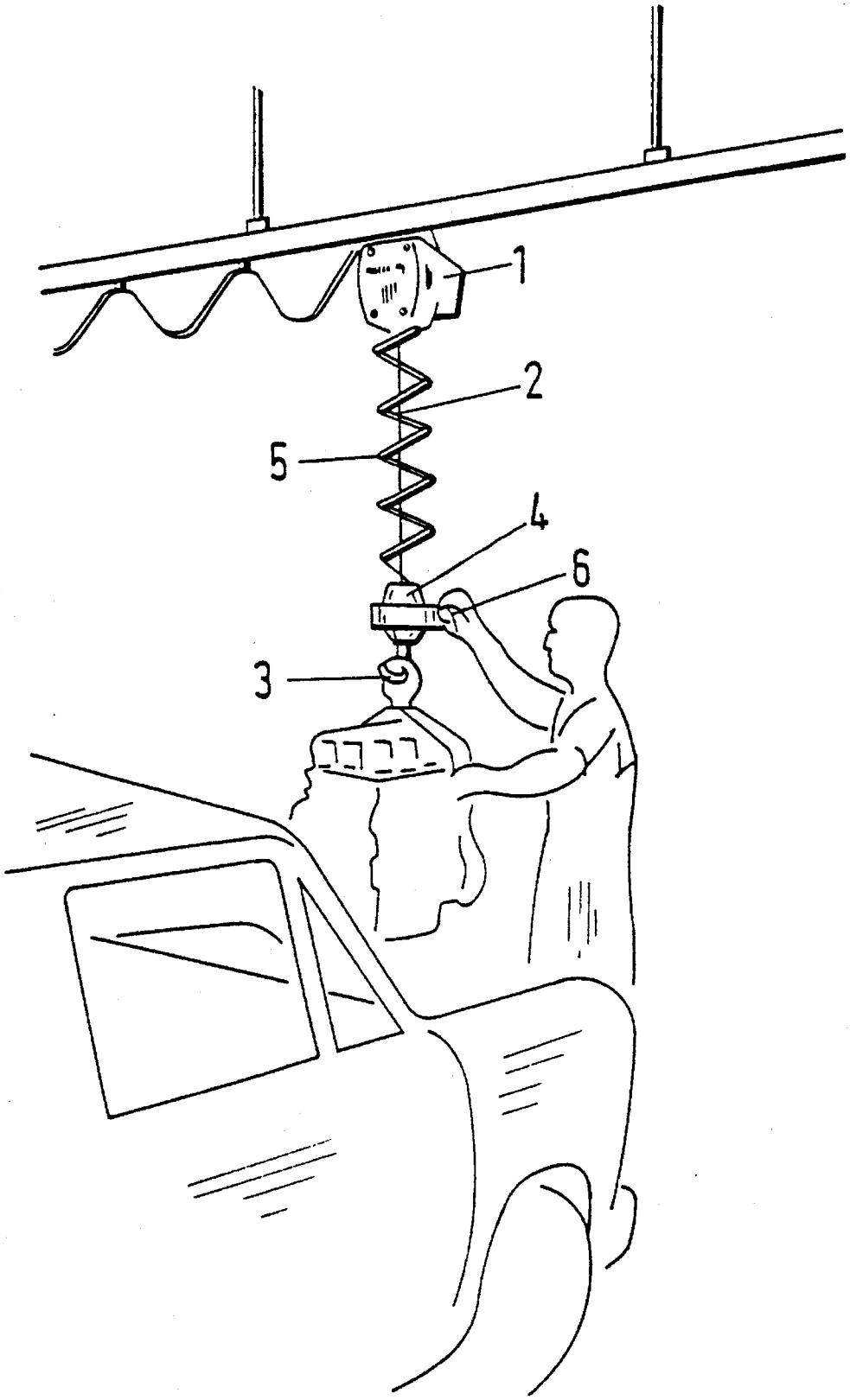
FIG. 1 shows a hoist pursuant to the present invention with a lifting device and a control device arranged at the traction mechanism during the lowering of a motor into a passenger automobile.

FIG. 1 shows a hoist with a lifting device 1 which can be moved horizontally at a rail. The lifting device 1 serves to raise and lower a load suspension device 3 which is constructed as a hook and is connected with the lifting device I via a traction mechanism 2. A control device 4 is arranged between the load suspension device 3 and the end of the traction mechanism 2. The control device 4 contains switching members, not shown, which serve to switch the lifting device I via a control line 5 which is guided in a helical manner around the traction mechanism 2. Moreover, the control device 4 has a handle 6 which is arranged horizontally—when the control device 4 is considered as vertically suspended at the traction mechanism—on the front side of a housing. The handle 6 is used by an operator for manual guidance of the load suspended at the control device 4 via the load suspension device 3.

Figure 2:
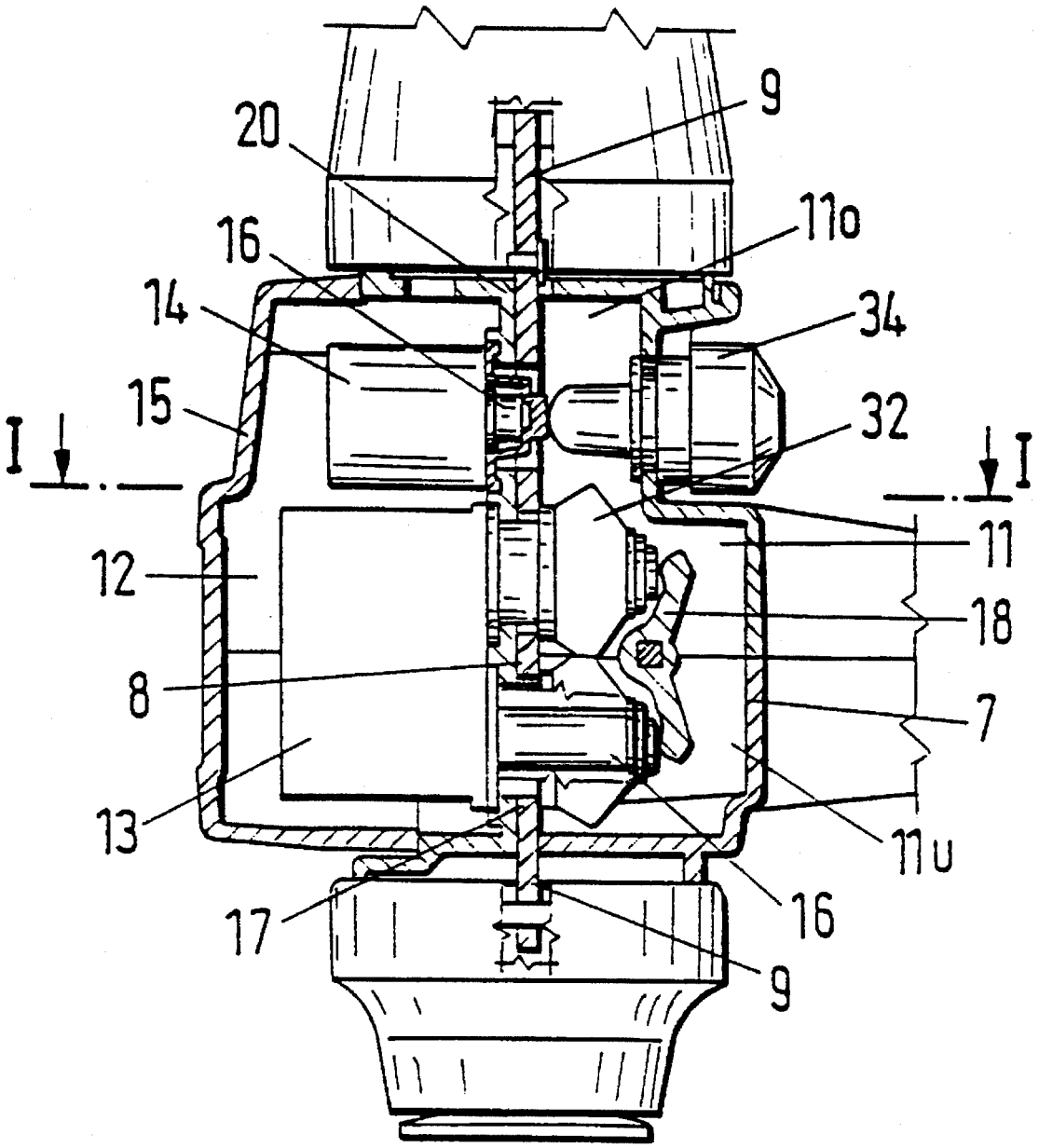
FIG. 2 shows a longitudinal section through the control device.

FIG. 2 shows a longitudinal section through a control device 4 according to the invention showing part of the handle 6. It can be seen that the control device 4 substantially comprises a housing 7 and a connecting element 8 which is constructed in particular as a sheet-steel strip. The connecting element 8 extends in the longitudinal direction through the entire housing 7 and projects out of the housing 7 at the top and at the bottom when the control device 4 is viewed as suspended at the traction mechanism 2. FIG. 2 also shows that the connecting element 8 and a dividing wall 20 divide the interior of the housing 7 into a mechanical part 11 and an electrical part 12 along the longitudinal dimension of the handle 6 and parallel thereto. The switching members 13 for controlling the lifting device 1 are designed particularly as push snap-switches and are arranged in the electrical part 12 along with an emergency-stop switching member 14. The switching members 13, 14 which are arranged one above the other are enclosed by side walls 19, the dividing wall 20 of the housing 7, and by the connecting element 8 in the manner of a container. The electrical part 12 of the housing 7 which is open toward the outside is closed in a water-tight and dust-tight manner by a cover 15 which is also constructed in the manner of a container. When the cover 15 is removed, the switching members 13, 14 project out toward the back over the side walls 19 of the housing 7.

The mechanical part 11 of the housing 7 serves to receive the switching tappets 16 of the switching members 13, 14, which switching tappets 16 are guided through bore holes 17 in the connecting element 8 and the dividing wall 20. The mechanical part 11 also receives the actuating mechanism for the transmission of switching forces proceeding from the outside to switching rockers, not shown, arranged at the housing 7 to a two-armed lever 18 which is supported on a lever shaft 24 and can actuate the two switching tappets 16 of the switching member 13. The two-armed lever 18 has a neutral center position in which neither of the tappets 16 connected to the switching member 13 is actuated. One of the switching tappets 16 of the switching member 13 is operative to raise the hoist while the other of the two tappets 16 is operative to lower the hoist. The switching tappet 16 of the emergency-stop switching member 14 can be actuated via a push button 34 which is arranged in the housing wall on the front side of the mechanical part 11 above the handle 6. The switching tappets 16 are enclosed within the mechanical part 11 by sealing members 32 which are constructed as rubber diaphragms and close tightly with the bore holes 17. The sealing members 32 are hat-shaped and are provided with a circumferentially extending notch in their side wall to enable an intentional collapsing of the sealing member 32 when the switching tappet 16 is actuated. FIG. 2 also shows that the mechanical part 11 of the housing 7 is divided horizontally into an upper part **11*o* and a lower part 11*u* at the height of the lever shaft 24 which is situated at the same height as the center of the handle 6**.

The upper pan **11*o* also has a dividing plane which extends vertically and parallel to the connecting element 8 so that when the upper part 11*o* is removed the electrical pan 12 and the lower pan 11*u* of the housing are L-shaped as viewed from the side and the upper pan 11*o*** is consequently angular.

Figure 3:
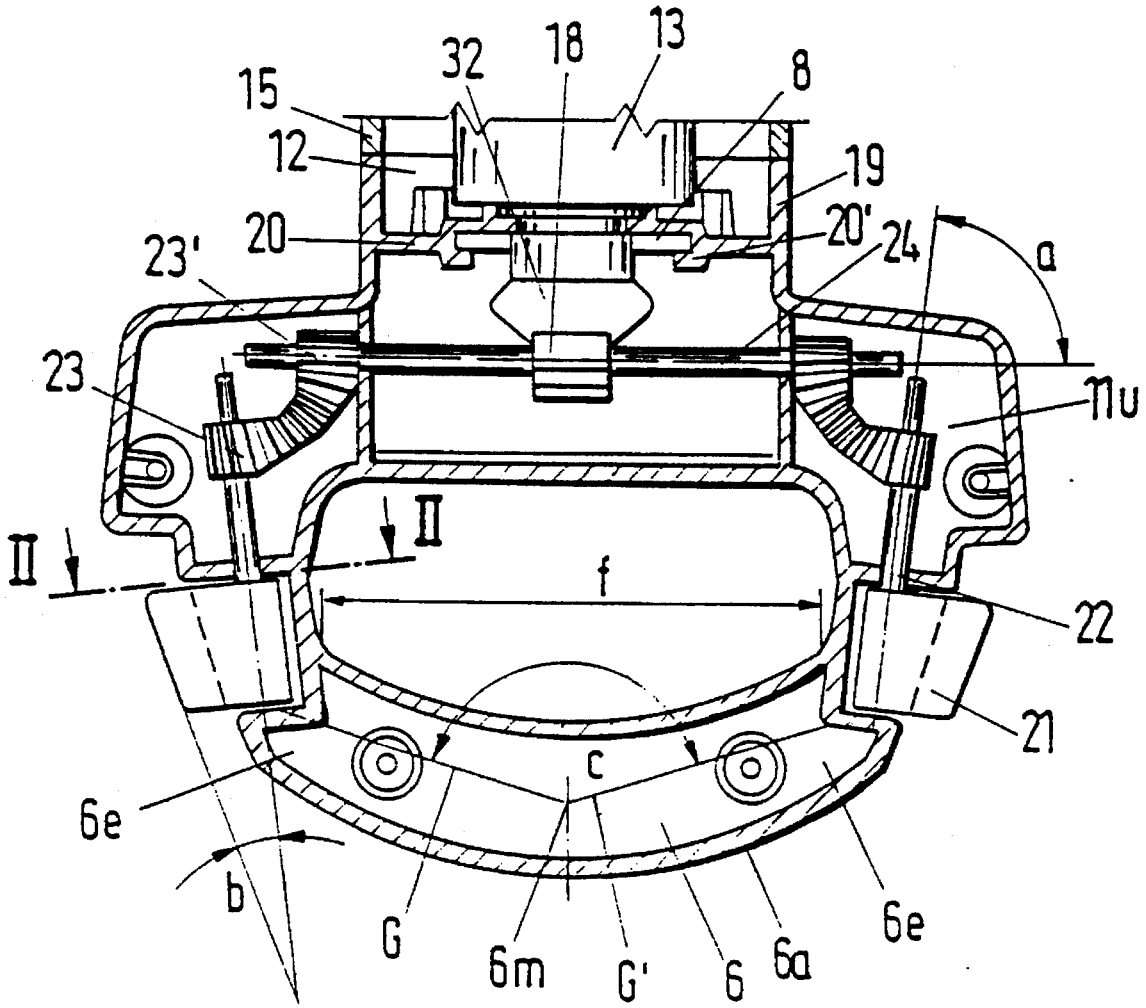
FIG. 3 shows a cross section through the control device according to section line I—I in FIG. 2.

FIG. 3 shows a cross section through the control device 4 according to the invention with the omission of the upper pan **11*o* of the housing 7 according to section line I—I in FIG. 2. This figure clearly shows that the electrical pan 12 of the housing 7 is defined by the side wall 19 of the housing 7, the connecting element 8, the dividing wall 20, and the cover 15. The container-shaped electrical pan 12 of the housing 7 is formed by side walls 19 and the base is formed by the connecting element 8 and the dividing wall 20. The connecting element 8 extends parallel to and adjacent to the dividing wall 20 and is gripped at its lateral edges by webs 20'. The webs 20' are fastened to the dividing wall 20 and accordingly form a connection between the housing 7 and the connecting element 8 supported by the housing 7**.

FIG. 3 also shows the construction of the mechanical part 11 of the housing 7. The housing 7 of the mechanical pan 11 essentially has the shape of an oval ring at the height of the handle 6. The handle 6, which is a structural component pan of the mechanical pan 11 of the housing 7, is located at a longitudinal side of the oval. The mechanical pan 11 of the housing 7 assumes a square shape on the side located opposite the handle 6 and merges toward the rear with the likewise square electrical part 12 of the housing 7. A switching rocker 21 which is swivelable around horizontal rocker shafts 22 supported in the housing 7 is arranged in the area of each of the two ends of the curved handle 6. The ends of the rocker shafts 22 remote of the switching rockers 21 are provided with toothed-wheel segments 23 which mesh with other toothed-wheel segments 23'. The toothed- wheel segments 23' are arranged at the ends of a common lever shaft 24 whose longitudinal dimension is directed parallel to the width of the housing 7. The two-armed lever 18 is slid into the center of the horizontal lever shaft 24 and serves to actuate the switching tappet 16 of switching member 13 via its ends.

The rocker shafts 22 and the lever shaft 24 are arranged at an angle a relative to one another. The angle a is approximately 70° to 85°, particularly 83°. This causes an inclination of the rocker shaft 22 in the direction of the center **6*m* of the handle 6. This inclination continues in the supporting surface 25 for the actuating thumb at the switching rocker 21, since this supporting surface 25 is inclined at an angle b of approximately 10° to 20°, particularly 15°, to the axis of the rocker shaft 22. The central region 27 of the supporting surface 25—shown in dash-dot lines—(see also FIG. 5) merges smoothly into the outside 6*a* of the handle to prevent an uncomfortable edge for the actuating thumb. In order to achieve this balance between the central region 27 and the outside 6***a* of the handle, the angle between the rocker shaft 22 and the central region 27 is somewhat smaller than the angle b, i.e. between 5° and 15°, particularly 10°. Moreover, the handle 6 is shaped as a ring segment which is curved in a convex manner as seen from the electrical part 12 of the housing. The curvature of the handle 6 is selected in such a way that the outside 6*a* of the handle 6 intersects the supporting surface 25 of the switching rocker 21 in an imaginary prolongation of the curvature. The curvature of the handle 6 and the angular position of the supporting surface 25 are directed toward one another so that the transition from the handle 6 to the supporting surface 25 is as smooth as possible and accordingly ensures an ergonomic attitude of the hand, particularly the thumb. Moreover, the handle 6 is constructed so as to be symmetrical to an imaginary plane extending vertically and transversely through the center 6*m* of the handle 6. To assist in describing the curvature of the handle 6, two straight lines G may be drawn; the angle c enclosed by these straight lines G serves as a measurement for the curvature of the handle. The straight lines G start in the center 6*m* of the handle as seen in the transverse and longitudinal directions and extend through the center of the ends 6*e* of the handle as seen in the transverse direction. The enclosed angle c is between 150° and 170°, particularly 160°. The width f of the handle 6 is 100 to 110 mm, particularly 105 mm.

FIG. 4 shows a front view of the connecting element 8, which is constructed in particular as a steel plate. The connecting element 8 is shaped like a strip and is provided on its flat side and in its center with three bore holes 17 arranged at a distance from one another in the longitudinal direction. The switching tappets 16 are guided through these bore holes 17. Two additional fastening bore holes 26 are arranged at the ends of the connecting element 8. Positive-locking pins which are structural component parts of one half of the longitudinally divided connection pieces 10 are inserted into these fastening bore holes 26. Another bore hole 26' arranged between the fastening bore holes 26 serves to receive a screw, not shown, for connecting the longitudinally divided connection pieces 10 with the connecting element 8. The lower connection piece 10 is connected with the load suspension device 3, whose stud is shown in part. The upper connection piece 10 serves to fasten the traction mechanism 2 to the connecting element 8. The connection pieces 10 and the ends 9 of the connecting element 8 projecting out of the housing 7 at the top and bottom are covered by caps 31. The lower cap 31 is vertically displaceable so that the stud for fastening the load suspension device can be unlocked.

FIG. 5 shows a section from the area of the switching rocker 21 according to section line II—II in FIG. 3, wherein the switching rocker 21 is actuated downward and the upper part 11*o* of the housing 7 is included. As to its function, the switching rocker 21 is comparable to a two-armed lever and has a central bore hole for receiving the rocker shaft 22 so that the lever arms have the same length.

On the side remote of the housing 7 and projecting out of the housing 7, the switching rocker 21 has a supporting surface 25 for the thumb of the actuating hand, this supporting surface 25 being inclined in the direction of the rocker shaft 22. The supporting surface 25 is divided into a central region 27, a transition region 28, and an edge region 29. The central region 27 of the supporting surface 25 is arranged opposite the rocker shaft 21 so that the lever arms are very short. Furthermore, the central region 27 is curved in a slightly convex manner as seen from the outside. The central region 27 serves to receive the actuating thumb in the neutral position and has a width e of 15 to 22 mm, particularly 20 mm, directed transversely to the rocker shaft 22. In the neutral position of the switching rocker 21, the central region 27 is aligned vertically. Adjoining the central region 27 at the top and bottom are transition regions 28 of small radius which then pass into a perceptible edge 30 in the edge region 29. The edge regions 29 and the central region 27 are arranged at an angle d of 25° to 35°, particularly 28°, relative to one another. The free ends of the edge region 29 have a projection 29' on the side remote of the actuating surface 25, so that the edge region 29, as a whole, has a hook-shaped construction when viewed from the side. The length of the switching rocker 21 is selected so that the edge region 29 projects out over the contour of the housing 7 at the top and bottom when the actuated edge region 29 abuts at the housing 7. In so doing, the projection 29' is directed toward the wall of the housing. Another important dimension is the distance g between the inside of the handle end 6*e* and the edge region 29 of an actuated switching rocker 25. This distance g assumes values of 15 to 25 mm, particularly 21 mm, and accordingly determines the distance between the surface of the thumb and the lateral surface of the index finger. The selected values allow a forceful actuation of the switching rocker 25, but one which is not fatiguing. Moreover, it can be seen that a flap 33 is guided on a round projection of the switching rocker 21. A driver swivels the flap 33 along with the switching rocker 21 when the latter is actuated and the flap 33 accordingly closes a gap occurring between the housing 7 and the end of the switching rocker 21 which is not actuated.

The invention is not limited by the embodiments described above which are presented as examples only but can be modified in various ways within the scope of protection defined by the appended patent claims.

We claim:

1. A hoist comprising: load suspension means; lifting means for raising and lowering the load suspension means; a traction mechanism connecting the suspension means with the lifting means; and control means for the lifting means and the load suspension means, the control means being connected with the load suspension means and including a housing, a handle having a horizontally directed longitudinal dimension for manipulating the load suspension means, switching members arranged in the housing which are actuable for controlling the lifting means, switching rockers operatively arranged in the housing to actuate the switching members, and horizontally extending rocker shafts, each of the switching rockers being inclined toward the handle and connected to one end of the one of the rocker shafts so that each switching rocker is rotatable with its respective rocker shaft, each of the switching rockers having an outer supporting surface located so as to be reachable by a thumb of an operator's hand grasping the handle, the handle being curved so that an imaginary line continuing from an outer surface of the handle intersects each of the switching rockers near the supporting surface, the supporting surface of each of the switching rockers including a flat central region located opposite the rocker shaft formed so as to receive the operator's thumb in a neutral position of the switching rocker, and two edge regions that adjoin a top and bottom, relative to a direction transverse to the rocker shafts, of the central region to form an angle in which the operator's thumb can be received.

2. A hoist according to claim 1, wherein the handle has opposite ends in the longitudinal direction, one of the switching rockers being arranged in a region of each of the ends of the handle, and further comprising a common lever shaft, the rocker shafts respectively having second ends remote from the switching rockers, the second ends of the rocker shafts being connected with the common lever shaft, a two-armed lever being centrally arranged on the common lever shaft so as to actuate the switching members.

3. A hoist according to claim 2, wherein the switching members are push snap-switches.

4. A hoist according to claim 2, and further comprising toothed-wheel segments arranged on the common lever shaft and the rocker shafts so that the common lever shaft is driveably connected with the rocker shafts.

5. A hoist according to claim 2, wherein the common lever shaft forms an angle between 70° and 85° with each of the rocker shafts, the housing being arranged to project laterally out over the switching rockers.

6. A hoist according to claim 2, wherein the supporting surface and the rocker shaft of each of the switching rockers forms an angle between 10° and 20°.

7. A hoist according to claim 1, wherein the curved hand has a central longitudinal axis and is curved so that an angle enclosed by two imaginary straight lines that extend through a center point of the handle along the longitudinal axis and a center point of the ends of the handle, defined by a point where the longitudinal axis exits the handle ends, is between 150° and 170°.

8. A hoist according to claim 7, wherein each of the straight lines forms an obtuse angle with an adjacent supporting surface of the switching rockers.

9. A hoist according to claim 8, wherein the obtuse angle is between 135° and 170°.

10. A hoist according to claim 1, wherein the handle is symmetrical to a plane extending vertically through a center of the handle.

11. A hoist according to claim 1, wherein the central region and the end region of the supporting surface form an angle between 25° and 35°.

12. A hoist according to claim 1, wherein a curved transition region is provided between the central region and each of the edge regions of the supporting surface, the transition region defines an edge where it joins each of the edge regions.

13. A hoist according to claim 1, wherein the central region has a width between 15 and 25 mm.

14. A hoist according to claim 1, wherein the housing has a contour, the switching rockers projecting out over the contour of the housing in the actuating position with a portion of the edge region of the actuated side of the switching rocker, a projection directed toward the housing being provided on the portion of the edge region projecting out over the contour of the housing.

15. A hoist according to claim 1, wherein the load suspension means includes a hook.

* * * * *